US009040904B2

(12) United States Patent
Shimada et al.

(10) Patent No.: US 9,040,904 B2
(45) Date of Patent: May 26, 2015

(54) ANALYSIS METHOD, ADHESIVE TAPE, AND PEN

(75) Inventors: Haruo Shimada, Kanagawa (JP); Yoshimasa Nakatani, Kanagawa (JP); Yuka Noritake, Kanagawa (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 0 days.

(21) Appl. No.: 13/877,360

(22) PCT Filed: Oct. 5, 2011

(86) PCT No.: PCT/JP2011/072993

§ 371 (c)(1),
(2), (4) Date: Apr. 2, 2013

(87) PCT Pub. No.: WO2012/046774

PCT Pub. Date: Apr. 12, 2012

(65) Prior Publication Data

US 2013/0187034 A1 Jul. 25, 2013

(30) Foreign Application Priority Data

Oct. 7, 2010 (JP) ..... 2010-227728

(51) Int. Cl.

| | |
|---|---|
| ***H01J 49/26*** | (2006.01) |
| ***H01J 49/00*** | (2006.01) |
| *H01J 49/14* | (2006.01) |

(52) U.S. Cl.

CPC ..... *H01J 49/0027* (2013.01); *H01J 49/0009* (2013.01); *H01J 49/14* (2013.01)

(58) Field of Classification Search

USPC ..... 250/281, 282, 288

See application file for complete search history.

(56) References Cited

U.S. PATENT DOCUMENTS

| | | | | |
|---|---|---|---|---|
| 2002/0160428 | A1 | 10/2002 | Sundrehagen | |
| 2008/0067348 | A1* | 3/2008 | Musselman | 250/284 |
| 2009/0090855 | A1* | 4/2009 | Kobold et al. | 250/282 |
| 2009/0242752 | A1 | 10/2009 | Murakami et al. | |
| 2009/0266980 | A1 | 10/2009 | Sano | |
| 2012/0028342 | A1* | 2/2012 | Ismagilov et al. | 435/283.1 |

FOREIGN PATENT DOCUMENTS

| | | |
|---|---|---|
| JP | S64-23158 | 1/1989 |
| JP | 10-293127 | 11/1998 |

(Continued)

OTHER PUBLICATIONS

Haunschmidt et al. "Rapid identification of stabilisers in polypropylene using time-of-flight mass spectrometry and DART as ion source", The Analyst, 2010, 135 pp. 80-85.*

(Continued)

*Primary Examiner* — Nicole Ippolito
(74) *Attorney, Agent, or Firm* — IPUSA, PLLC

(57) ABSTRACT

There is provided an analysis method including the steps of forming a layer including a calibration reagent, that can generate ions by using a DART ion source apparatus, in a predetermined area of a sample, and performing mass spectrometry on the ions generated from an area of the sample including the layer by using DART or DESI while moving the sample having the layer formed therein.

17 Claims, 11 Drawing Sheets

(56) References Cited

FOREIGN PATENT DOCUMENTS

| | | |
|---|---|---|
| JP | 2004-527760 | 9/2004 |
| JP | 2007-298328 | 11/2007 |
| JP | 2008-180659 | 8/2008 |
| JP | 2009-243902 | 10/2009 |
| WO | WO 2007/055293 | 5/2007 |

OTHER PUBLICATIONS

International Search Report mailed on Nov. 22, 2011.

Manuela Haunschmidt, Christian W. Klampfl , Wolfgang Buchberger and Robert Hertsens, Rapid identification of stabilisers in polypropylene using time-of-flight mass spectrometry and DART as ion source, Analyst, vol. 135 No. 1, Jan. 2010, p. 80-85.

Japanese Office Action dated Oct. 21, 2014.

* cited by examiner

ANALYSIS METHOD, ADHESIVE TAPE, AND PEN

TECHNICAL FIELD

The present invention relates to an analysis method, an adhesive tape, and a pen.

BACKGROUND ART

Although many methods for atmospheric pressure ionization are known, methods as DART (Direct Analysis in Real Time) (Registered U.S. Trademark) or DESI (Desorption Electrospray Ionization) is recently drawing attention (see Patent Document 1).

DART is a method that adds protons (being generated by Penning ionization of atoms or molecules in which atoms or molecules of an electronic excited state collide with water in the atmosphere) to a sample and ionizes the sample. For example, in a case of using helium (He ($2^3S$) of a metastable excited state, a sample M can be ionized by performing the following.

$$He(2^3S))+H_2O \rightarrow H_2O^{+*}+He(1^1S)+e^-$$

$$H_2O^{+*}+H_2O \rightarrow H_3O^+ + OH^*$$

$$H_3O^+ + nH_2O \rightarrow [(H_2O)_nH]^+$$

$$[(H_2O)_nH]^+ + M \rightarrow MH^+ + nH_2O$$

Here, "He($2^3S$)" indicates helium of a triplet metastable excited state, "$H_2O^{+*}$" indicates a radical of $H_2O$, and "$MH^+$" is an example of an object ionized by adding protons to a sample.

DESI is a method that adheres an ionized solution to a sample and desorbs ions.

When measuring a sample by using DART or DESI, there is a case where a mass spectrometer is to be calibrated by using a calibration reagent. Further, when detecting a position of a chemical substance while moving a sample to which the chemical substance is adhered by using DART or DESI, there is a case where a reference position cannot be arbitrarily set.

PRIOR ART DOCUMENT

Patent Document

Patent Document 1: Japanese Laid-Open Patent Publication No. 2008-180659

DISCLOSURE OF THE INVENTION

Problems to be Solved by the Invention

In view of the above-described conventional art, the present invention is aimed to provide an analysis method, an adhesive tape and a pen used for the analysis method that allow setting a reference position for detecting a position of a chemical substance adhered to a sample using DART or DESI and allowing calibration of a mass spectrometer.

Means of Solving the Problems

According to a first feature of the present invention, an analysis method is characterized by including the steps of forming a layer including a calibration reagent, that can generate ions by using a DART ion source apparatus, in a predetermined area of a sample, and performing mass spectrometry on the ions generated from an area of the sample including the layer by using DART or DESI while moving the sample having the layer formed therein.

According to a second feature of the present invention, it is characterized by including forming the adhesive tape including the calibration reagent.

According to a third feature of the present invention, it is characterized by including forming the layer including the calibration agent by using a pen filled with an ink including the calibration reagent.

According to a fourth feature of the present invention, it is characterized in that the calibration reagent includes one or both of polyethylene glycol having a mass spectrum including equally spaced peaks (PEG 60-PEG 2000) or a fatty acid having a carbon number of 4-36.

According to a fifth feature of the present invention, an adhesive tape is characterized by including a calibration reagent that can generate ions by using a DART ion source apparatus.

According to a sixth feature of the present invention, it is characterized in that the calibration reagent includes one or both of polyethylene glycol having a mass spectrum including equally spaced peaks (PEG 60-PEG 2000) or a fatty acid having a carbon number of 4-36.

According to a seventh feature of the present invention, a pen is characterized by including an ink filled in the pen and including a calibration reagent that can generate ions by using a DART ion source apparatus.

According to an eighth feature of the present invention, it is characterized in that the calibration reagent includes one or both of polyethylene glycol having a mass spectrum including equally spaced peaks (PEG 60-PEG 2000) or a fatty acid having a carbon number of 4-36.

Effects of the Invention

The present invention can provide an analysis method, an adhesive tape and a pen used for the analysis method that allow setting a reference position for detecting a position of a chemical substance adhered to a sample using DART or DESI and allowing calibration of a mass spectrometer.

EMBODIMENTS FOR CARRYING OUT THE INVENTION

Next, embodiments for carrying the present invention are described with reference to the accompanying drawings.

Figure 1:
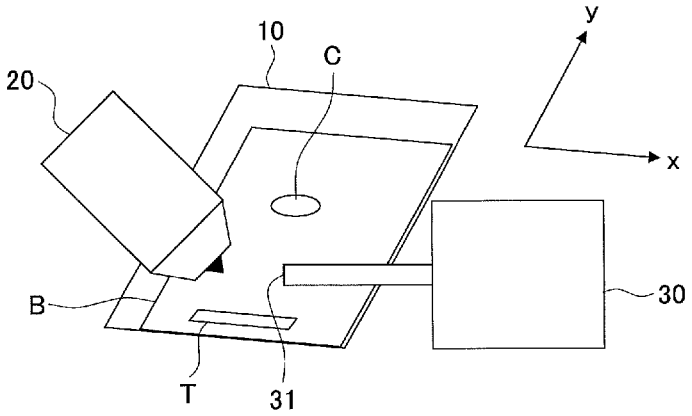
FIG. 1 is schematic diagram illustrating an example of an analysis method of the present invention.

FIG. 1 illustrates an example of an analysis method of the present invention. First, a rectangular flat plate B having a chemical substance C adhered thereto is placed on a sample stage 10 that is capable of moving in an x-axis direction and a y-axis direction. Then, an adhesive tape T including a calibration reagent is adhered to an area included in the flat plate B (in the x-axis direction) that contains the chemical substance C. Then, ions are generated by adding protons (which are generated by Penning ionization in which metastable excited helium (He ($2^3S$)) from a DART ion source apparatus 20 are caused to collide with water in the atmosphere while the sample stage 10 is moved in the y-axis direction) to the chemical substance C of the flat plate B and the calibration reagent included in the adhesive tape T, and guided into an ion entrance port 31 of a mass spectrometer 30, to thereby perform mass spectrometry. Here, an interval $g_i$ of an intermediate point between the chemical substance C and the adhesive tape T with respect to the chemical substance C and the adhesive tape T where $x=x_i$ is expressed as $$G_i=v(y_i-y_{i0}); \quad \text{[Formula I]}$$

in a case where "v[mm/s]" is the speed of moving the sample stage 10 in the y-axis direction, "$y_{i0}$[s]" is the highest point of a peak derived from the calibration reagent of a mass chromatogram where $x=x_i$, and "$y_i$[s]" is a starting point of a peak derived from the chemical substance. Here, the mass spectrometer 30 can be calibrated by using a mass spectrum of a peak derived from the calibration reagent of the mass chromatogram.

The calibration reagent is not limited in particular as long as ions can be generated by using the DART ion source apparatus 20. However, in view of the accuracy of calibration, it is preferable to use, for example, polyethylene glycol having a mass spectrum including equally spaced peaks (PEG 60-PEG 2000) or a fatty acid having a carbon number of 4-36, or use two or more types of the above.

The adhesive tape T including the calibration reagent may be obtained by, for example, applying a solution having a calibration reagent dissolved in a solvent to a commonly known adhesive tape.

For example, neon of a metastable excited state, argon of a metastable excited state, or nitrogen of a metastable excited state may be used instead of helium (He ($2^3S$)) of a metastable excited state.

The sample is not limited to the rectangular flat plate B having the chemical substance C adhered thereto as long as ions can be generated by using the DART ion source apparatus 20.

Figure 2:
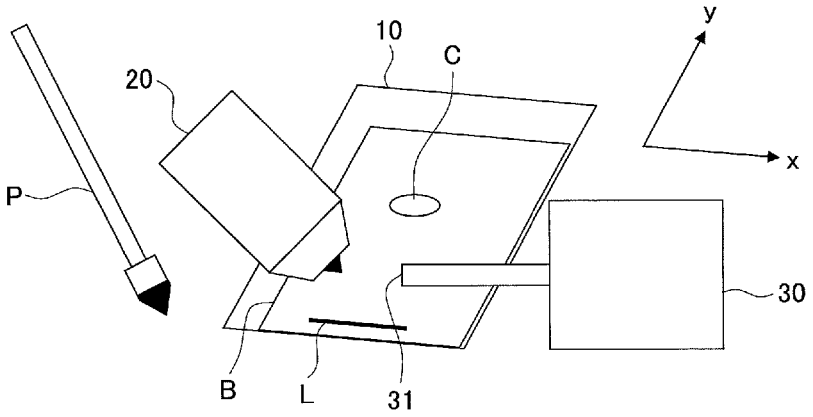
FIG. 2 is a schematic diagram illustrating another example of the analysis method of the present invention.

FIG. 2 illustrates another example of an analysis method of the present invention. First, the rectangular flat plate B having the chemical substance C adhered thereto is placed on the sample stage 10 that is capable of moving in an x-axis direction and a y-axis direction. Then, by using a pen P filled with an ink including a calibration reagent, a reference line L is drawn in an area included in the flat plate B (in the x-axis direction) that contains the chemical substance C. Then, ions are generated by adding protons (which are generated by Penning ionization in which metastable excited helium (He ($2^3S$)) are caused to collide with water in the atmosphere by using the DART ion source apparatus 20 while the sample stage 10 is moved) to the chemical substance C of the flat plate B and the calibration reagent included in the reference line L, and guided into the ion entrance port 31 of the mass spectrometer 30, to thereby perform mass spectrometry.

The ink including the calibration reagent is obtained by adding, for example, a solution having a calibration reagent dissolved in a solvent to a commonly known ink. Further, the pen P may be obtained by, for example, filling the ink including the calibration reagent into a commonly known pen.

As a method for forming a layer including a calibration reagent, the present invention is not limited to the methods illustrated in FIG. 1 or FIG. 2. Other methods may be, for example, coating with a brush.

Further, ions may be desorbed by adding an ionized solvent to a sample by using a DESI ion source instead of using the DART ion source apparatus 20.

Although the solvent for ionization is not limited in particular, the solvent may be, for example, methanol, a methanol solution, acetonitrile, or an acetonitrile solution.

It is to be noted that the solvent for ionization may include an acidic substance or a basic substance.

The calibration reagent is not limited in particular as long as ions can be generated by using a DESI ion source. However, in view of the accuracy of calibration, it is preferable to use, for example, polyethylene glycol having a mass spectrum including equally spaced peaks (PEG 60-PEG 2000) or a fatty acid having a carbon number of 4-36), or use two or more types of the above.

The sample is not limited in particular as long as ions can be generated by using the DESI ion source.

Embodiments

[Manufacturing of Adhesive Tape T]

After forming multiple 1 mm×17 mm incisions in a label sheet for an inkjet printer (manufactured by Kokuyo Co., Ltd.), a mixture of 5 mL of a methanol solution (1 g/L) of polyethylene glycol 200 (manufactured by Wako Pure Chemical Industries, Ltd.) having an average molecular weight of 180-220 and 5 mL of a methanol solution (1 g/L) of a polyethylene glycol 400 (manufactured by Kanto Chemical Co. Inc.) having an average molecular weight of 380-420 is evenly sprayed to the label sheet. Thereby, the adhesive tape T is obtained.

[Manufacturing of Pen P]

0.5 mL of polyethylene glycol 200 (manufactured by Wako Pure Chemical Industries, Ltd.) having an average molecular weight of 180-220 and 0.5 mL of polyethylene glycol 400 (manufactured by Kanto Chemical Co. Inc.) having an average molecular weight of 380-420 are added to a supplementary ink for an Artline Wetrite (red) (Shachihata Kogyo Co., Ltd.) and agitated. Thereby, ink is obtained.

The obtained ink is filled into an Artline Wetrite (red) (Shachihata Kogyo Co., Ltd.). Thereby, the pen P is obtained.

[First Embodiment]

After applying an external pharmaceutical preparation 1 including urea, lidocaine, and diphenhydramine to a slide glass, analysis is performed using the analysis method of FIG. 1. More specifically, after placing the slide glass applied with the external pharmaceutical preparation 1 on the sample stage 10, the adhesive tape T is adhered to an area of the slide glass (in the x-axis direction) to which the external pharmaceutical preparation 1 is applied, so that the interval of an intermediate point between the area to which the external pharmaceutical preparation 1 is applied and the adhesive tape T in the y-axis direction becomes 48 mm. Then, ions are generated by adding protons (which are generated by Penning ionization in which metastable excited helium (He ($2^3S$)) are caused to collide with water in the atmosphere by using the DART ion source apparatus 20 while the sample stage 10 is moved in the y-axis direction at a speed of 0.2 mm/s) to the urea, lidocaine, and diphenhydramine included in the external pharmaceutical preparation 1 of the slide glass, and guided into the ion entrance port 31 of the mass spectrometer 30, to thereby perform mass spectrometry.

Here, a DART SVP (manufactured by AMR Inc.) is used as the DART ion source apparatus 20, and the temperature of a gas heater is set to 500° C. Further, a MicrOTOFQII (manufactured by Bruker Daltonics K.K.) is used as the mass spectrometer 30, and the measurement mode is set to positive ion mode.

Figure 3:
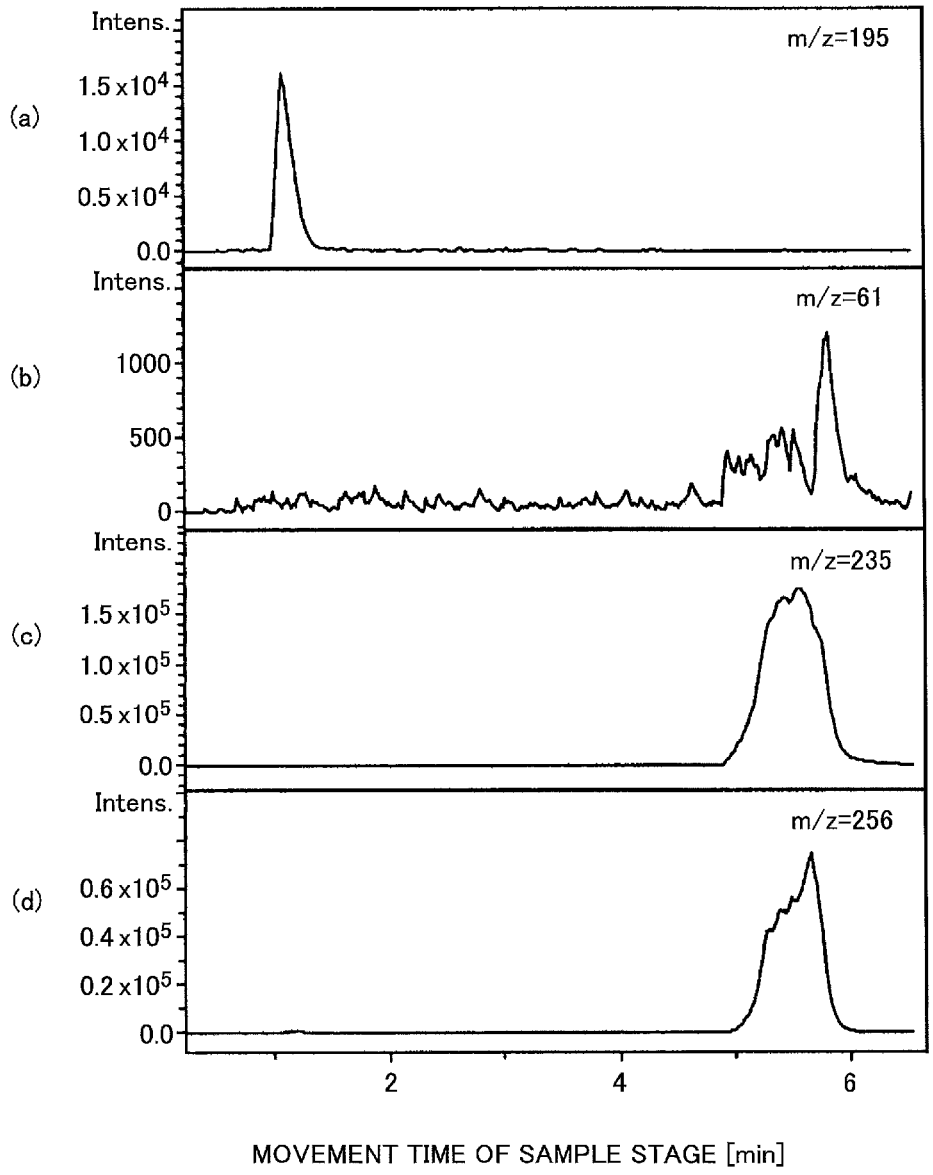
FIG. 3 is a diagram illustrating a mass chromatogram according to a first embodiment.

FIG. 3 illustrates obtained mass chromatograms. It is to be noted that (a), (b), (c), and (d) of FIG. 3 are mass chromatograms corresponding to polyethylene glycol (m/z=195), urea (m/z=61), lidocaine (m/z=235), and diphenhydramine (m/z=256), respectively.

It can be understood from FIG. 3 that, the highest point of a peak derived from polyethylene glycol, the starting point of a peak derived from urea, the starting point of a peak derived from lidocaine, and the starting point of a peak derived from diphenhydramine is 1 min, 5 min, 5 min, and 5 min, respectively. According to the above, the interval of the intermediate point between the area to which the external pharmaceutical preparation 1 is applied and the adhesive tape T in the y-axis direction becomes 48 mm. Thus, measurement can be performed with high accuracy.

Figure 4:
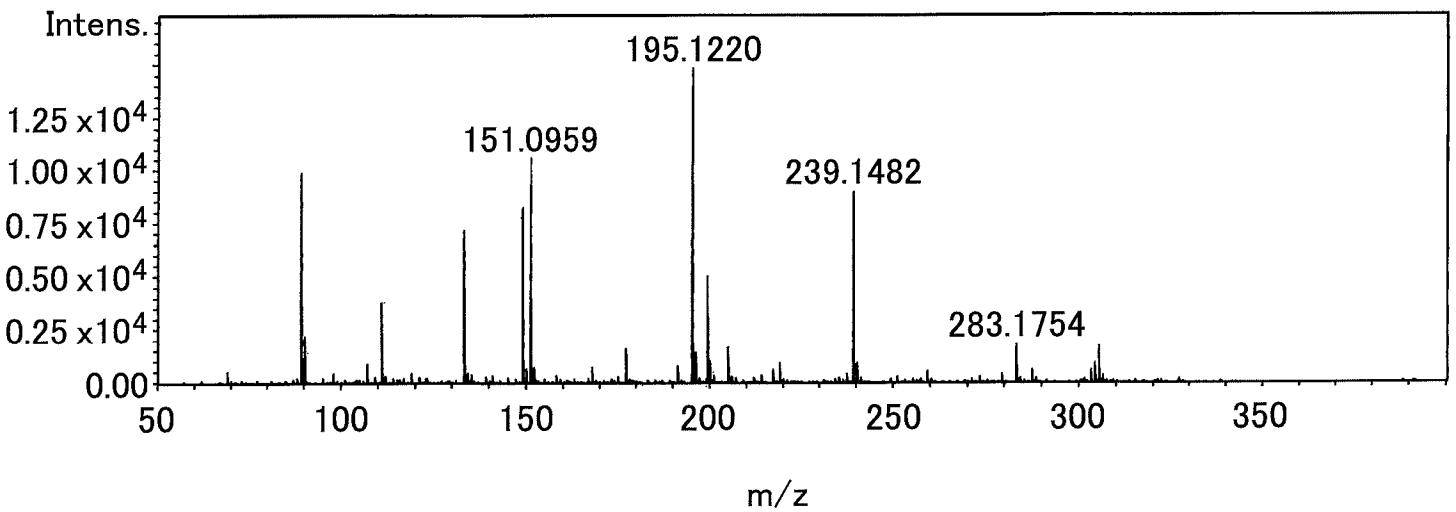
FIG. 4 is a diagram illustrating a mass spectrum in 1.0 min of FIG. 3.
Figure 5:
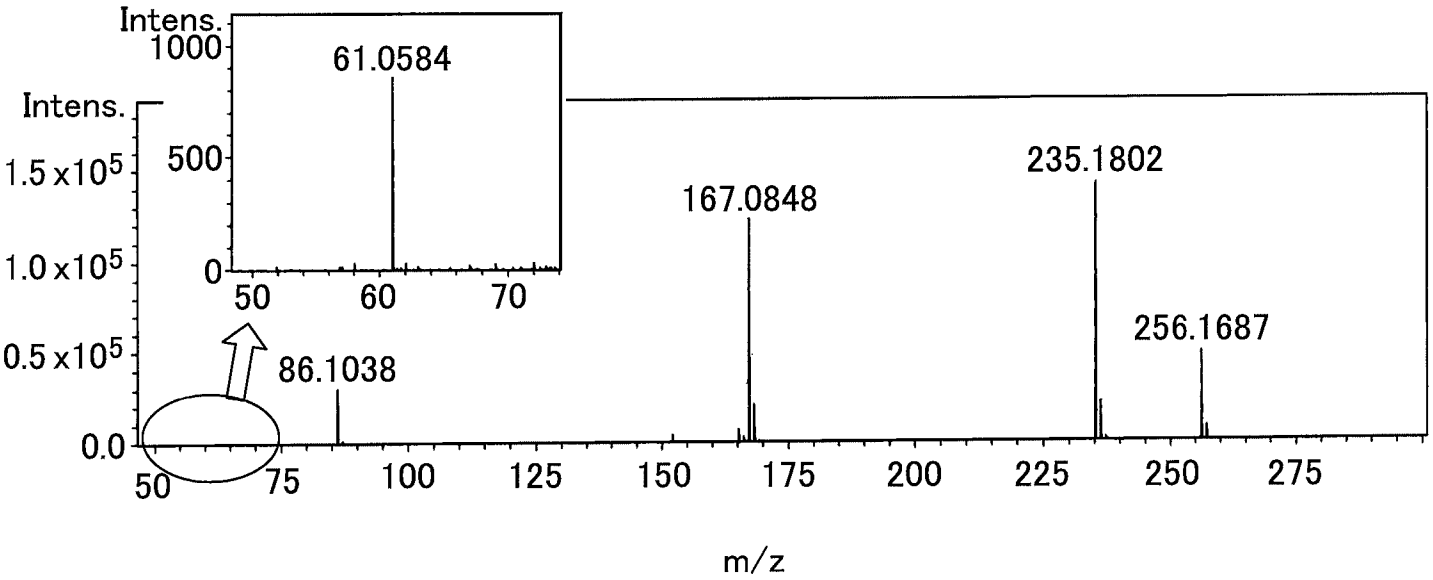
FIG. 5 is a diagram illustrating a mass spectrum in 5.5 min of FIG. 3.

FIGS. 4 and 5 illustrate a mass spectrum corresponding to 1.0 min of FIG. 3 and a mass spectrum corresponding to 5.5 min of FIG. 3, respectively.

It can be understood from FIG. 4 that, peaks derived from polyethylene glycol (m/z=151, 195, 239, 283) exist. It is to be noted that the mass spectrometer 30 is calibrated by using the peaks.

It can be understood from FIG. 5 that, a peak derived from urea (m/z=61), a peak derived from lidocaine (m/z=235), and a peak derived from diphenhydramine (m/z=256) exists, respectively.

Second Embodiment

Analysis is performed in a similar manner as the first embodiment except that the adhesive tape T is adhered to a work glove instead of the slide glass, so that the interval of the intermediate point between the area to which the external pharmaceutical preparation 1 is applied in the y-axis direction and the adhesive tape T in the y-axis direction becomes 24 mm.

Figure 6:
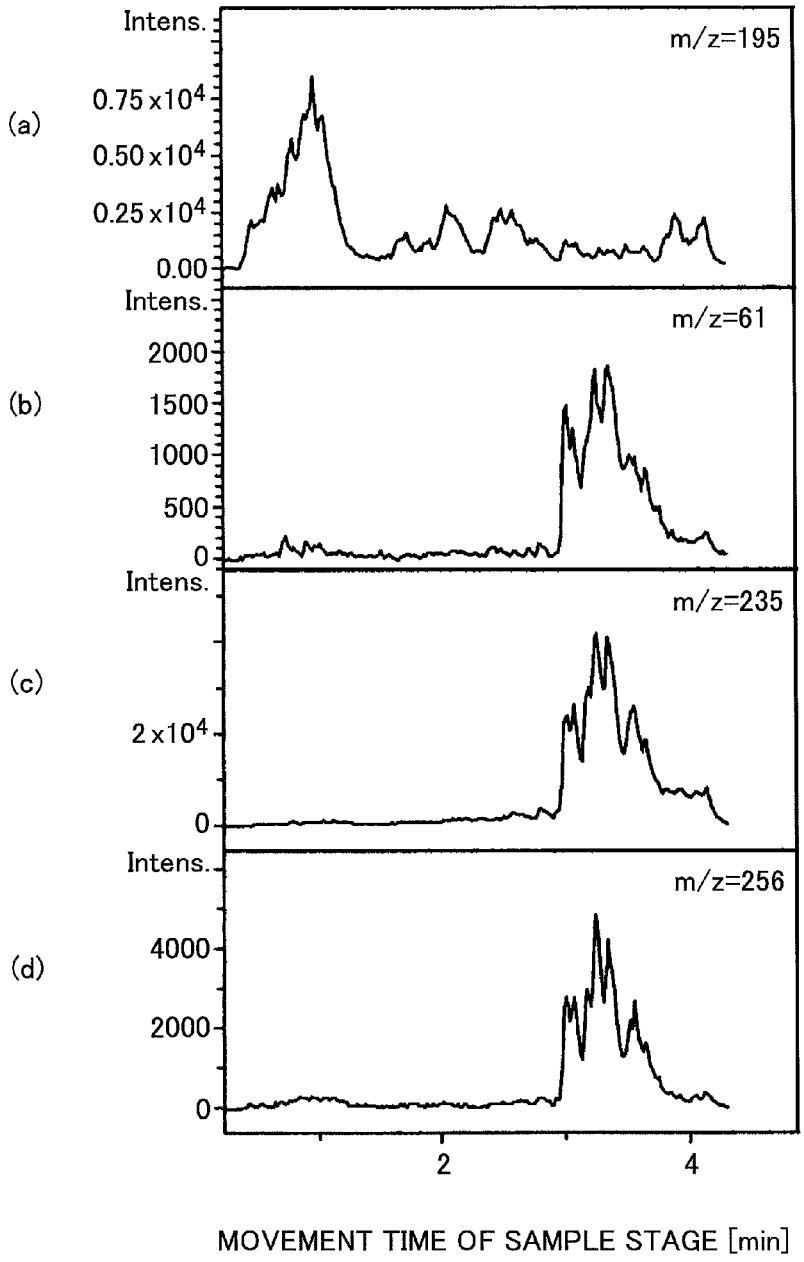
FIG. 6 is a diagram illustrating a mass chromatogram according to a second embodiment.

FIG. 6 illustrates obtained mass chromatograms. It is to be noted that (a), (b), (c), and (d) of FIG. 6 are mass chromatograms corresponding to polyethylene glycol (m/z=195), urea (m/z=61), lidocaine (m/z=235), and diphenhydramine (m/z=256), respectively.

It can be understood from FIG. 6 that, the highest point of a peak derived from polyethylene glycol, the starting point of a peak derived from urea, the starting point of a peak derived from lidocaine, and the starting point of a peak derived from diphenhydramine is 1 min, 3 min, 3 min, and 3 min, respectively. According to the above, the interval of the intermediate point between the area to which the external pharmaceutical preparation 1 is applied and the adhesive tape T in the y-axis direction becomes 24 mm. Thus, measurement can be performed with high accuracy.

Figure 7:
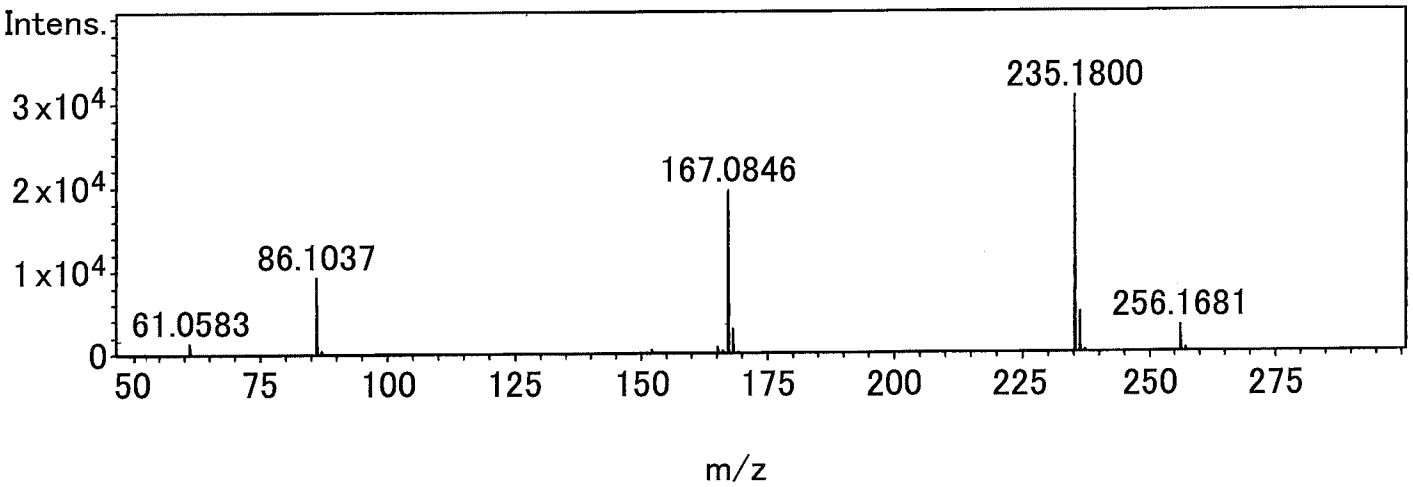
FIG. 7 is a diagram illustrating a mass spectrum in 3.2 min of FIG. 6.

FIG. 7 illustrates a mass spectrum corresponding to 3.2 min of FIG. 6.

It can be understood from FIG. 7 that, a peak derived from urea (m/z=61), a peak derived from lidocaine (m/z=235), and a peak derived from diphenhydramine (m/z=256) exists, respectively.

Third Embodiment

Analysis is performed in a similar manner as the first embodiment except that a box is used instead of the slide glass and an external pharmaceutical preparation 2 including diphenhydramine is used instead of the external pharmaceutical preparation 1, so that the interval of the intermediate point between the area to which the external pharmaceutical preparation 2 is applied in the y-axis direction and the adhesive tape T in the y-axis direction becomes 40.8 mm.

Figure 8:
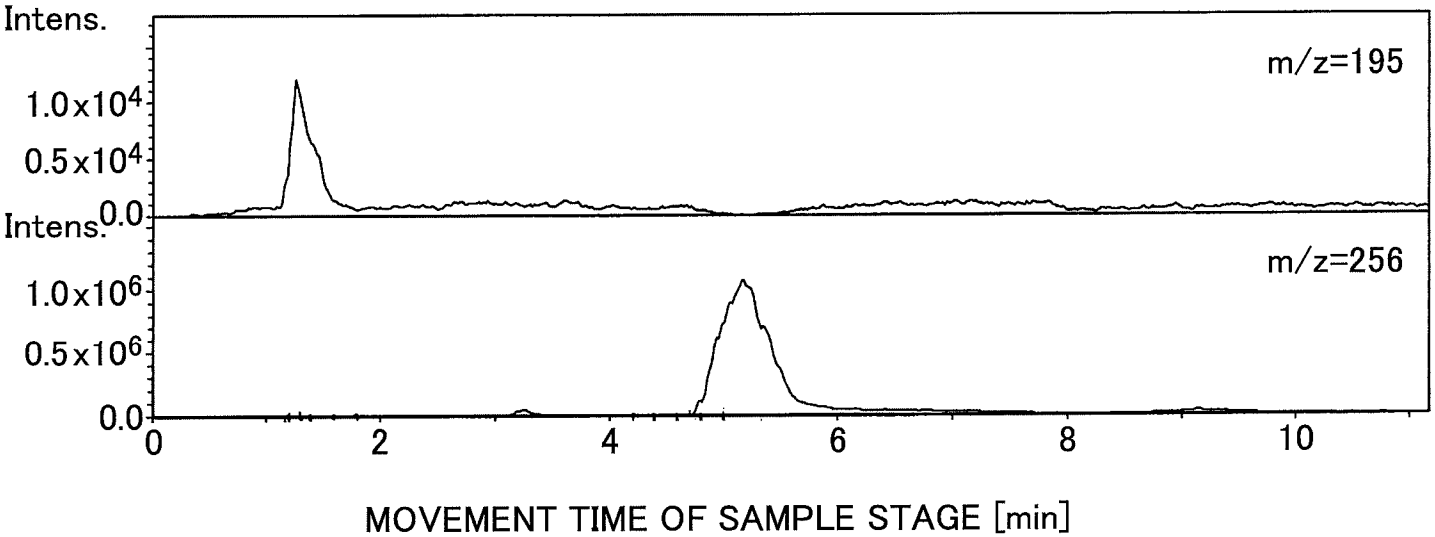
FIG. 8 is a diagram illustrating a mass chromatogram according to a third embodiment.

FIG. 8 illustrates obtained mass chromatograms. It is to be noted that (a) and (b) of FIG. 8 are mass chromatograms corresponding to polyethylene glycol (m/z=195) and diphenhydramine (m/z=256), respectively.

It can be understood from FIG. 8 that, the highest point of a peak derived from polyethylene glycol and the starting point of a peak derived from diphenhydramine is 1.3 min and 4.7 min, respectively. According to the above, the interval of the intermediate point between the area to which the external pharmaceutical preparation 2 is applied and the adhesive tape T in the y-axis direction becomes 40.8 mm. Thus, measurement can be performed with high accuracy.

Figure 9:
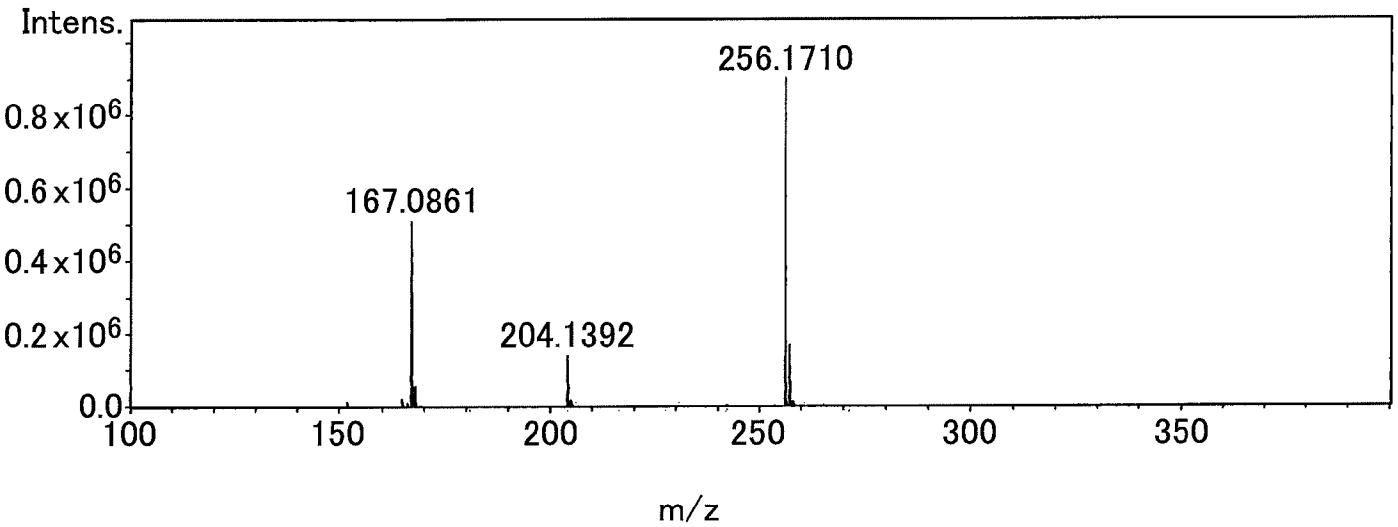
FIG. 9 is a diagram illustrating a mass spectrum in 5.2 min of FIG. 8.

FIG. 9 illustrates a mass spectrum corresponding to 5.2 min of FIG. 8.

It can be understood from FIG. 9 that, a peak derived from diphenhydramine (m/z=256) exists.

Fourth Embodiment

10 μL of a methanol solution (1 g/L) of dimethyl phthalate (hereinafter referred to as "solution 1"), 10 μL of a methanol solution (1 g/L) of diethyl phthalate (hereinafter referred to as "solution 2"), and 10 μL of a methanol solution (1 g/L) of di-isopropyl phthalate (hereinafter referred to as "solution 3") are applied to a slide glass in a straight-line manner at intervals of 24 mm. Then, analysis is performed by using the analysis method illustrated in FIG. 2. More specifically, first, a slide glass applied with the solutions 1-3 is placed on the sample stage 10. Then, by using the pen P, a reference line L is drawn in an area of the slide glass (in the x-axis direction) to which the solutions 1-3 are applied, so that the interval of the intermediate point between the area to which the solution 1 is applied and the reference line L in the y-axis direction becomes 7.2 mm. Then, ions are generated by adding protons (which are generated by Penning ionization in which metastable excited helium (He ($2^3S$)) are caused to collide with water in the atmosphere by using the DART ion source apparatus 20 while the sample stage 10 is moved in the y-axis direction at a speed of 0.2 mm/s) to the dimethyl phthalate, the diethyl phthalate, and the di-isopropyl phthalate of the slide glass and the polyethylene glycol included in the reference line L, and guided into the ion entrance port 31 of the mass spectrometer 30, to thereby perform mass spectrometry.

Figure 10:
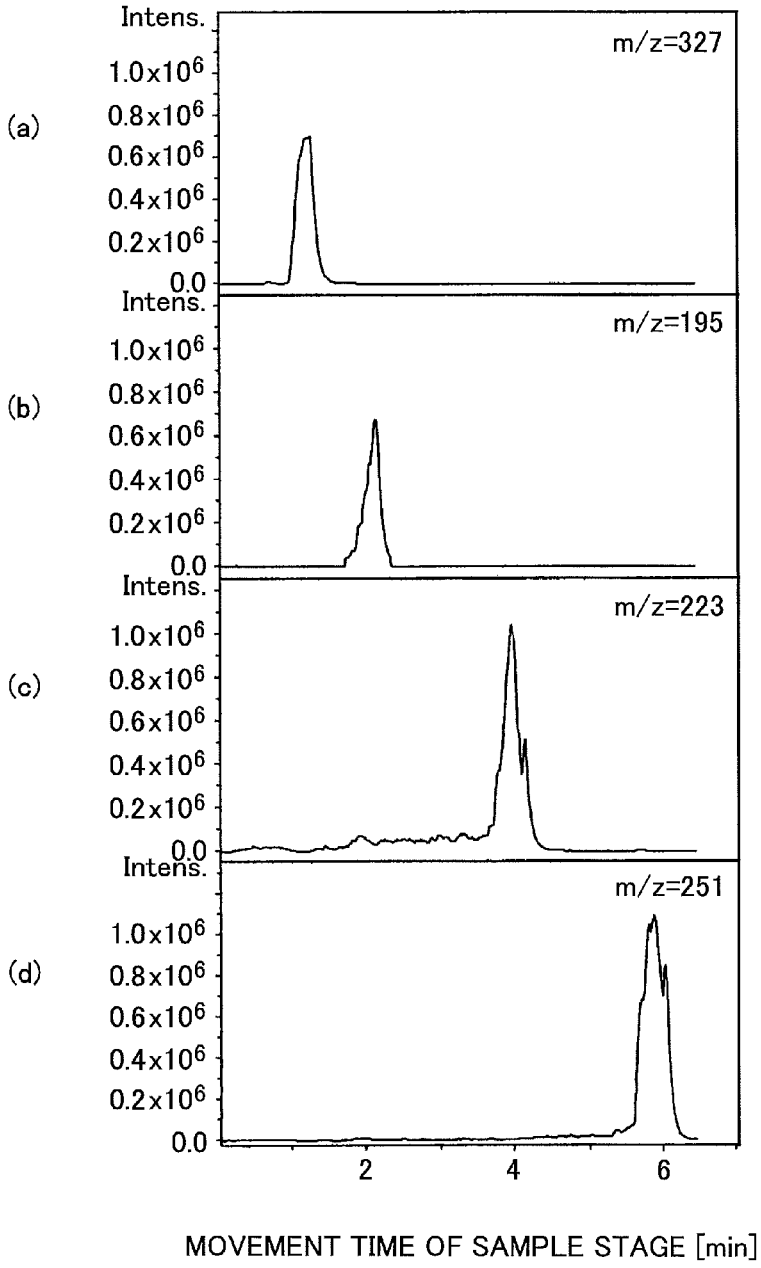
FIG. 10 is a diagram illustrating a mass chromatogram according to a fourth embodiment.

FIG. 10 illustrates obtained mass chromatograms. It is to be noted that (a), (b), (c), and (d) of FIG. 10 are mass chromatograms corresponding to polyethylene glycol (m/z=327), dimethyl phthalate (m/z=195), diethyl phthalate (m/z=223), and di-isopropyl phthalate (m/z=251), respectively.

It can be understood from FIG. 10 that, the highest point of a peak derived from polyethylene glycol, the starting point of a peak derived from dimethyl phthalate, the starting point of a peak derived from diethyl phthalate, and the starting point of a peak derived from di-isopropyl phthalate is 1.1 min, 1.7 min, 3.7 min, and 5.7 min, respectively. According to the above, the interval of the intermediate point between the areas to which solution 1, solution 2, and solution 3 are applied and the reference line L in the y-axis direction becomes 7.2 mm, 31.2 mm, and 55.2 mm, respectively, and the solutions 1, 2, and 3 are applied at intervals of 24 mm. Thus, measurement can be performed with high accuracy.

Figure 11:
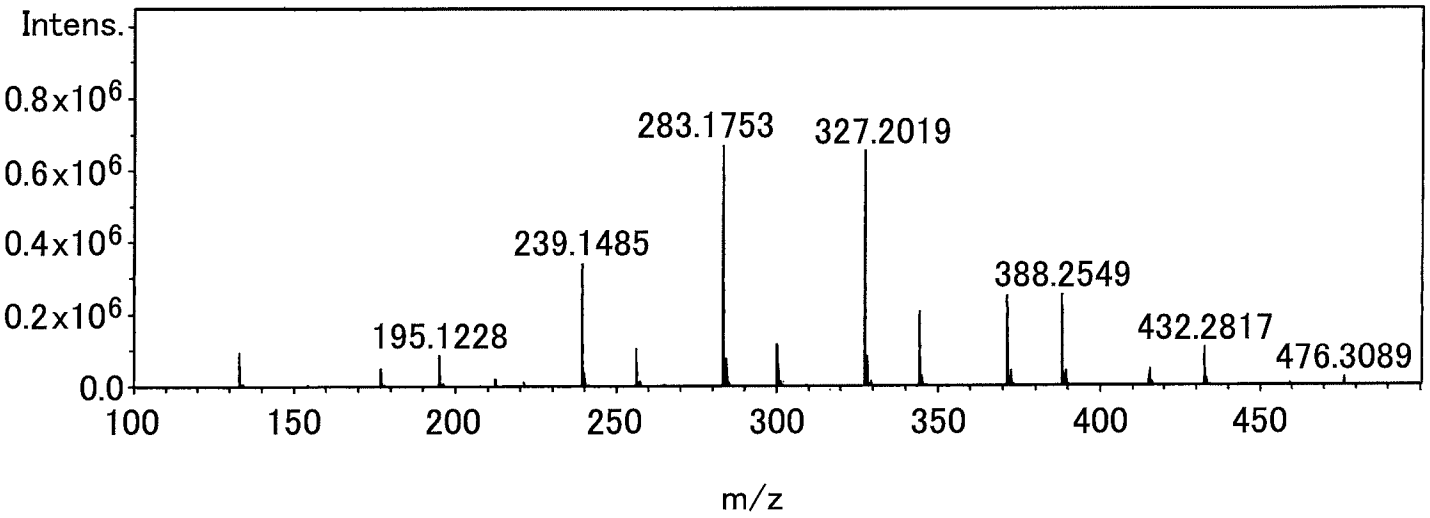
FIG. 11 is a diagram illustrating a mass spectrum in 1.1 min of FIG. 10.
Figure 12:
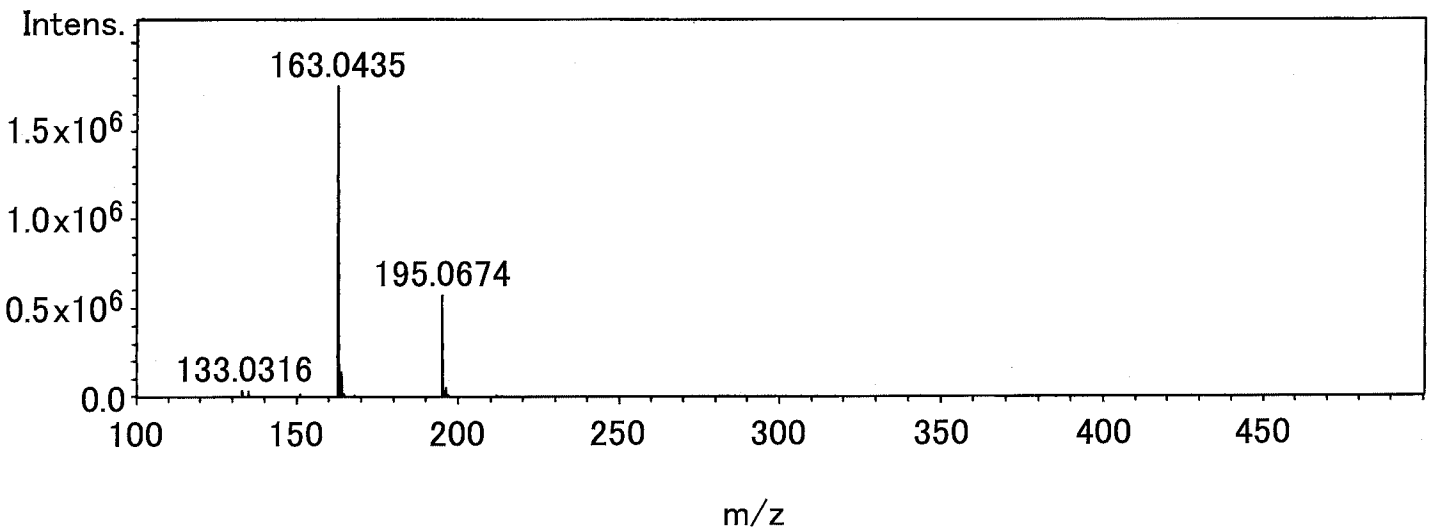
FIG. 12 is a diagram illustrating a mass spectrum in 2.0 min of FIG. 10.

FIGS. 11 and 12 illustrate a mass spectrum corresponding to 1.1 min of FIG. 10 and a mass spectrum corresponding to 2.0 min of FIG. 10, respectively.

It can be understood from FIG. 11 that, peaks derived from polyethylene glycol (m/z=195, 239, 283, 327) exist. It is to be noted that the mass spectrometer 30 is calibrated by using the peaks.

It can be understood from FIG. 12 that, a peak derived from dimethyl phthalate (m/z=195) exists.

Further, the present invention is not limited to these embodiments, but variations and modifications may be made without departing from the scope of the present invention.

DESCRIPTION OF THE REFERENCE NUMERALS

10 sample stage
20 DART ion source apparatus
30 mass spectrometer
31 ion entrance port
B flat plate
C chemical substance
T adhesive tape
L reference line
P pen

The invention claimed is:

1. An analysis method comprising the steps of:
forming a layer including a calibration reagent, that can generate ions by using a DART ion source apparatus, in a predetermined area of a sample; and
performing mass spectrometry on the ions generated from an area of the sample including the layer by using DART or DESI while moving the sample having the layer formed therein;
wherein the layer including the calibration reagent is formed in a straight-linear shape on a surface of the sample,
wherein the straight-linear shape of the layer including the calibration reagent is elongated in a direction orthogonal to a direction in which the sample is moved.

2. The analysis method as claimed in claim 1, wherein the layer including the calibration reagent is formed by adhering an adhesive tape including the calibration reagent.

3. The analysis method as claimed in claim 1, wherein the layer including the calibration reagent is formed by using a pen filled with an ink including the calibration reagent.

4. The analysis method as claimed in claim 1, wherein the calibration reagent includes one or both of polyethylene glycol having a mass spectrum including equally spaced peaks (PEG 60-PEG 2000) or a fatty acid having a carbon number of 4-36.

5. The analysis method as claimed in claim 1, wherein the layer including the calibration reagent extends in a direction that is parallel to the surface of the sample.

6. The analysis method as claimed in claim 5, wherein the direction that is parallel to the surface of the sample includes an X-axis direction of the sample.

7. The analysis method as claimed in claim 1,
further comprising a step of:
applying an external pharmaceutical preparation to another predetermined area of the sample;
wherein the layer including the calibration reagent is formed, so that an interval of an intermediate point between the predetermined area and the another predetermined area becomes a predetermined length.

8. An adhesive tape comprising:
a calibration reagent that can generate ions by using a DART ion source apparatus;
wherein the calibration reagent is formed in a layer of a predetermined area of a sample,
wherein the layer including the calibration reagent is formed in a straight-linear shape on a surface of the sample,
wherein the straight-linear shape of the layer including the calibration reagent is elongated in a direction orthogonal to a direction in which the sample is moved.

9. The adhesive tape as claimed in claim 8, wherein the calibration reagent includes one or both of polyethylene glycol having a mass spectrum including equally spaced peaks (PEG 60-PEG 2000) or a fatty acid having a carbon number of 4-36.

10. The adhesive tape as claimed in claim 8, wherein the layer including the calibration reagent extends in a direction that is parallel to the surface of the sample.

11. The adhesive tape as claimed in claim 10, wherein the direction that is parallel to the surface of the sample includes an X-axis direction of the sample.

12. The adhesive tape as claimed in claim 8,
wherein the sample includes another predetermined area to which an external pharmaceutical preparation is applied,
wherein the layer including the calibration reagent is formed, so that an interval of an intermediate point between the predetermined area and the another predetermined area becomes a predetermined length.

13. A pen comprising:
an ink filled in the pen and including a calibration reagent that can generate ions by using a DART ion source apparatus;
wherein the calibration reagent is formed in a layer of a predetermined area of a sample,
wherein the layer including the calibration reagent is formed in a straight-linear shape on a surface of the sample,
wherein the straight-linear shape of the layer including the calibration reagent is elongated in a direction orthogonal to a direction in which the sample is moved.

14. The pen as claimed in claim 13, wherein the calibration reagent includes one or both of polyethylene glycol having a mass spectrum including equally spaced peaks (PEG 60-PEG 2000) or a fatty acid having a carbon number of 4-36.

15. The pen as claimed in claim 13, wherein the layer including the calibration reagent extends in a direction that is parallel to the surface of the sample.

16. The pen as claimed in claim 15, wherein the direction that is parallel to the surface of the sample includes an X-axis direction of the sample.

17. The pen as claimed in claim 13,
wherein the sample includes another predetermined area to which an external pharmaceutical preparation is applied,
wherein the layer including the calibration reagent is formed, so that an interval of an intermediate point between the predetermined area and the another predetermined area becomes a predetermined length.

* * * * *